US005489067A

United States Patent [19]

Nakai et al.

[11] Patent Number: 5,489,067

[45] Date of Patent: * Feb. 6, 1996

[54] TURRET TYPE PRECISION YARN WINDER

[75] Inventors: Shoji Nakai, Ibaraki; Shuichiro Imai, Toyonaka, both of Japan

[73] Assignee: Kamitsu Seisakusho, Ltd., Itami, Japan

[ * ] Notice: The portion of the term of this patent subsequent to Jul. 20, 2010, has been disclaimed.

[21] Appl. No.: 174,122

[22] Filed: Dec. 22, 1993

Related U.S. Application Data

[60] Continuation-in-part of Ser. No. 52,331, Apr. 22, 1993, abandoned, which is a division of Ser. No. 689,950, May 22, 1991, Pat. No. 5,228,630.

[30] Foreign Application Priority Data

| | | | |
|---|---|---|---|
| Sep. 27, 1989 | [JP] | Japan | 1-249191 |
| Sep. 27, 1989 | [JP] | Japan | 1-249192 |
| Mar. 29, 1990 | [JP] | Japan | 2-329892 |
| Jun. 29, 1990 | [JP] | Japan | 2-170260 |
| Aug. 28, 1990 | [JP] | Japan | 2-89739 |

[51] Int. Cl.[6] ..... B65H 67/044; B65H 54/00

[52] U.S. Cl. ..... 242/18 A; 242/25 A

[58] Field of Search ..... 242/18 A, 25 A

[56] References Cited

U.S. PATENT DOCUMENTS

| | | | |
|---|---|---|---|
| 3,126,165 | 3/1964 | van Eijk | 242/25 A X |
| 3,490,707 | 1/1970 | Warshaw et al. | 242/18 A |
| 3,856,222 | 12/1974 | Wiist | 242/18 A |
| 3,921,923 | 11/1975 | Kuno et al. | 242/18 A |
| 4,106,710 | 8/1978 | Schippers et al. | 242/18 A X |
| 4,138,069 | 2/1979 | Bonzo et al. | 242/18 A |
| 4,216,920 | 8/1980 | Tambara et al. | 242/18 A |
| 4,431,138 | 2/1984 | Schiminski et al. | 242/18 A |
| 4,917,319 | 4/1990 | Lenk | 242/18 A |
| 5,016,829 | 5/1991 | Schippers et al. | 242/18 A |
| 5,029,762 | 7/1991 | Behrens et al. | 242/18 A |
| 5,228,630 | 7/1993 | Nakai et al. | 242/18 A |
| 5,344,090 | 9/1994 | Nakai et al. | 242/18 A |
| 5,407,143 | 4/1995 | Nakai et al. | 242/18 A |

FOREIGN PATENT DOCUMENTS

| | | |
|---|---|---|
| 1117576 | 2/1956 | France . |
| 1040690 | 10/1958 | Germany . |
| 0374536 | 11/1989 | Germany . |
| 49-9414 | 3/1974 | Japan . |
| 49-9413 | 3/1974 | Japan . |
| 54-17860 | 7/1979 | Japan . |
| 56-672631 | 4/1981 | Japan . |
| 421174 | 12/1934 | United Kingdom . |
| 1270823 | 4/1972 | United Kingdom . |

*Primary Examiner*—John P. Darling
*Assistant Examiner*—Michael R. Mansen
*Attorney, Agent, or Firm*—Paul & Paul

[57] ABSTRACT

A turret type precision winder having a turret disc on which a pair of bobbin chucks are held for carrying a working bobbin and an empty bobbin, respectively. A yarn winding operation is carried out on the working bobbin to form a package while a contact pressure is being applied on the package through a pressure roller. The pressure roller is controlled to be maintained at substantially a fixed position while the bobbin chuck of the working bobbin stepwisely moves away from the pressure roller. A positional relationship between the pressure roller, the bobbin chuck and a swingable member for supporting the pressure roller is defined so that a radial component $f_1$ of the contact pressure reduces as a package diameter increases.

3 Claims, 9 Drawing Sheets

TURRET TYPE PRECISION YARN WINDER

CROSS REFERENCE TO RELATED APPLICATION

This application is a continuation-in-part application of Ser. No. 08/052,331 filed on Apr. 22, 1993 now abandoned which is a divisional application of Ser. No. 07/689,950 filed on May 22, 1991 now issued as U.S. Pat. No. 5,228,630.

TECHNICAL FIELD

The present invention relates to a turret type yarn winder, in which a pair of chucks for holding bobbins are arranged on a turret disc symmetrically to each other relative to a center thereof, and a full package is formed on a bobbin held on one of the chucks, during which a yarn to be taken up is subjected to a reciprocating motion by a traverse guide while being applied with a contact pressure from a pressure roller onto a package surface, which full package is exchanged with an empty bobbin carried on the other chuck by the rotation of the disc so that the winding operation can be carried out without interruption. Particularly, it relates to a precision winder of the above type suitable for taking up a carbon fiber or a ceramic fiber, in which a yarn is taken up onto the bobbin at a constant winding ratio (that is, a ratio between a bobbin rotational speed and a traverse speed is maintained at a constant value during the package formation).

BACKGROUND ART

In the prior art turret type yarn winder, as shown in FIG. 8, a pair of chucks 1*a* and 1*b* are arranged in a winding position M and a waiting position N and, when yarn layers wound on a bobbin held on the chuck 1*a* reaches a predetermined amount; i.e., a full package has been formed; the positions of both the chucks 1*a* and 1*b* are exchanged with each other. In general, the chuck 1*a* on which the package is held always remains at an initial position, while a pressure roller 27' and a traverse guide 5' are gradually moved away from the chuck as the package is being developed.

In the above conventional turret type winder, there is a drawback in that a structure of the winder becomes complicated and a manufacturing cost thereof is expensive because it needs a mechanism for displacing the pressure roller and the traverse guide relative to the chuck and that for exchanging the winding position and the waiting position with each other when the full package is reached.

In addition, when a plurality of winders of the above type are arranged one above the other in a multistage manner, an installation space necessary therefor becomes larger. That is, as shown in FIG. 9, a horizontal room S is necessary for the individual winder for absorbing the outward displacement of the pressure roller 27' and the traverse guide 5' in accordance with the development of the package size as the increment of the yarn layers wound on the bobbin. In the multistage winder arrangement, it is apparent from the drawing that these horizontal odd rooms S are accumulated to a considerable widthwise length.

To solve the problem caused by the odd room S, one attempt is proposed, for example, in the U.S. Pat. No. 5,029,762, in which a pressure roller is supported by a rocker arm to be movable by a limited distance radially away from the package being formed on a bobbin chuck in a winding position, which movement of the pressure roller in accordance with the development of package is detected by a sensor to rotate a turret disc carrying the bobbin chuck in a bobbin position exchanging direction, so that the pressure roller can be maintained within a limited zone including an initial position as well as a contact pressure applied from the pressure roller becomes substantially constant throughout the package formation. This winder is of a random winding system in which a winding angle (an angle made between a yarn trace forming a yarn layer of the package and a plane perpendicular to the package axis) during the package formation is maintained at constant value. In the random winding system, the aforesaid winding ratio monotonously varies from the initiation to the ending of the package formation, during which it passes a plurality of critical points at which the winding ratio becomes an integer. Since the yarn wound on the adjacent layers on the package surface is arranged in a trace very close to each other when the winding ratio is closer to an integer, there is a risk to cause a so-called "ribbon wind" which must be avoided by any of ribbon breaking means. For example, in the winder disclosed in the above U.S. Patent, this ribbon breaking is carried out by periodically moving a traverse guide away from the pressure roller.

On the other hand, there is another system to be compared with the random winding system; a precision winding system, in which a package formation is carried out while maintaining a winding ratio at a constant value. According to this system, although the problem of ribbon wind can be avoided, there is a different problem in that since the winding angle gradually reduces as the package develops, the package may deform when the same has developed to a larger size to result in a so-called bulge on the lateral sides of the package because the inner yarn layers in the package are liable to be pushed outside from the lateral sides of the package to form a bulge. To avoid such the drawback, it is necessary to gradually decrease a contact pressure applied on the package during the winding operation, which pressure adjustment is far different from that disclosed in the U.S. Patent.

The present inventors have found that a precision winder is more suitable for taking up a sensitive fiber such as carbon fiber or ceramic fiber than a random winding type winder, on the view point of the generation of ribbon wind, and studied to develop the winder of the former type capable of eliminating the prior art drawbacks.

DISCLOSURE OF THE INVENTION

A first object of the present invention is to provide a turret type precision winder, simple in structure and requiring less installation space, in which a pressure roller and a traverse guide are maintained substantially at a fixed position during the package formation and instead a bobbin chuck holding a working bobbin on which the package formation is being continued moves away therefrom along an orbital path for the bobbin exchange in accordance with the package development, whereby the bobbin exchanging operation and the displacing operation of the bobbin chuck in accordance with the package development can be carried out using a common system.

A second object is to provide a winder of the above type, in which a contact pressure is gradually reduced from the initial stage to the final stage of the yarn winding operation in accordance with the package development, based on the variation of a relationship between a center of the pressure roller and that of the package, so that a package of an improved shape having no bulge can be obtained even by a precision winding system.

The above object can be achieved by a turret type precision winder, in which a pair of bobbin chucks are arranged on a turret disc parallel to and symmetrically with each other relative to a center of the turret disc; a yarn winding operation being carried out at a constant winding ratio on a bobbin carried by one of the bobbin chucks (hereinafter referred to as a "working bobbin") occupying a yarn-winding position while subjecting the yarn to a traverse motion through a traverse guide driven by a traverse cam synchronously rotating with the bobbin chuck and applying a contact pressure by a spring onto a surface of the working bobbin through a pressure roller rotatably secured on one end of a swingable member pivoted at a fixed point by the other end thereof on the outside of the orbital motion path, and simultaneously another bobbin carried on the other bobbin chuck occupying a waiting position being gradually displaced to the yarn-winding position for the next yarn winding operation; the turret disc being rotated in a stepwise manner by the repetition of start/stop of a stepping motor for driving the turret disc until the working bobbin becomes full at every instant when a predetermined increment of package diameter on the working bobbin has been detected by a detector, so that the position of the pressure roller is always maintained substantially at a fixed position, characterized in that;

the pressure roller is positioned substantially on a line connecting a rotational center (O') of the turret disc and a center ($O_2$) of the bobbin chuck occupying the yarn-winding position, and a pivotal point (O) of the swingable member is positioned at a point satisfying the relationship defined by the following formulas $$90° \leqq \theta_2 < \theta_1 < 180° \quad \text{(I)}$$

$$|\theta_1 - \theta_2| \geqq 30° \quad \text{(II)}$$

wherein θ is an angle defined between a line L extending from the center $O_1$ of the pressure roller to the pivotal point O and line $L_1$ extending from the center $O_1$ to a center $O_2$ of the bobbin chuck carrying the working bobbin at a winding-start position, and θ is an angle defined between the line L and line $L_2$ extending from the center $O_1$ to a center $O'_2$ of the bobbin chuck carrying the working bobbin at a full bobbin position.

The detector for detecting the displacement of the pressure roller is preferably a proximity switch.

BRIEF DESCRIPTION OF THE DRAWINGS

The present invention will be described in more detail below with reference to the drawings illustrating the preferable embodiments wherein.

BEST MODE FOR CARRYING OUT THE INVENTION

Basic Structure of the Invention

The basic constitution of the present invention will be described below.

Figure 1:
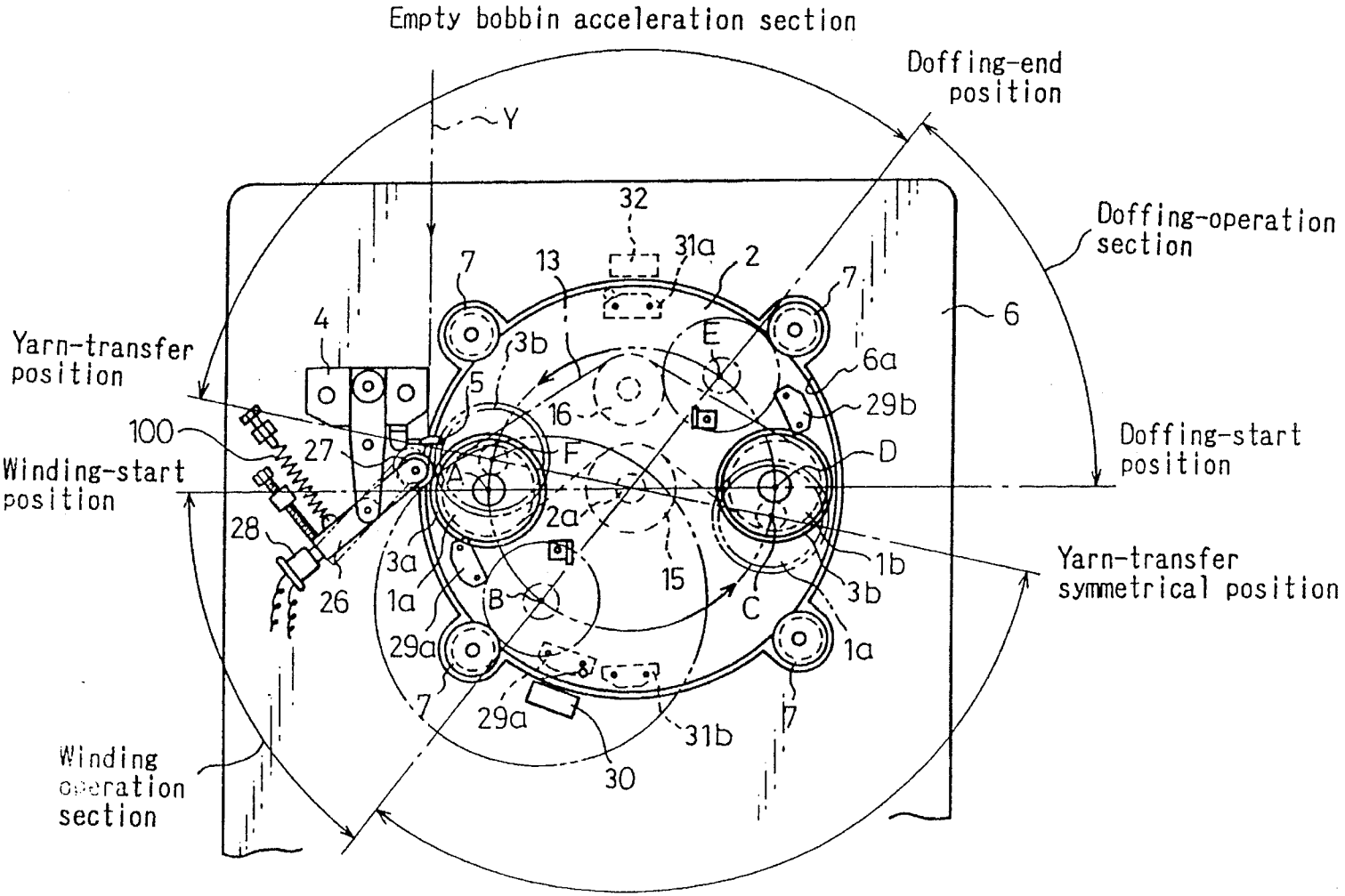
FIG. 1 is a front view of a winder according to the present invention, illustrating the respective positions of bobbins held on bobbin chucks.

According to this yarn winder, as illustrated in FIG. 1, a pair of bobbin chucks 1*a*, 1*b* are provided at diametrically symmetrical positions on a circle while held in rotation about their own axes, respectively. Regarding one bobbin chuck 1*a*, a bobbin 3*a* held thereon is first positioned at a winding-start position A and subjected to an orbital motion in the counterclockwise direction as the diameter thereof increases due to the yarn wound thereon; and reaches a full-bobbin position B when the bobbin has become full. When it has passed a doffing-start position D (via a yarn-transfer symmetrical position C) symmetrical to the winding-start position A, the full bobbin 3*a* is replaced by a fresh empty bobbin 3*b*. The fresh bobbin 3b is subjected to the orbital motion toward the winding-start position A via a doffing-end position E symmetrical to the full bobbin position B. Regarding the other bobbin chuck 1*b*, a bobbin held thereon, i.e., a fresh empty bobbin 3*b* just mounted in place of a full bobbin 3*a* while passing the doffing-start position D reaches a yarn-transfer position F via the doffing-end position E, and thereafter, runs on a path of the orbital motion while passing the winding-start position A, the full bobbin position B a yarn-transfer symmetrical position C, and the doffing-start position D. Thus, a yarn is continuously taken up without an interruption of yarn delivery by repeating the switching of both bobbin chucks.

Here, the doffing-start position D means a position where the doffing operation is possible on the bobbin chuck after it has passed this position, and similarly the doffing-end position E means a position where the doffing operation should be completed by the time the bobbin chuck has reached this position. Therefore, the actual doffing operation can be carried out at any position included in doffing section defined between the doffing-start position D and the doffing-end position E.

Figure 2:
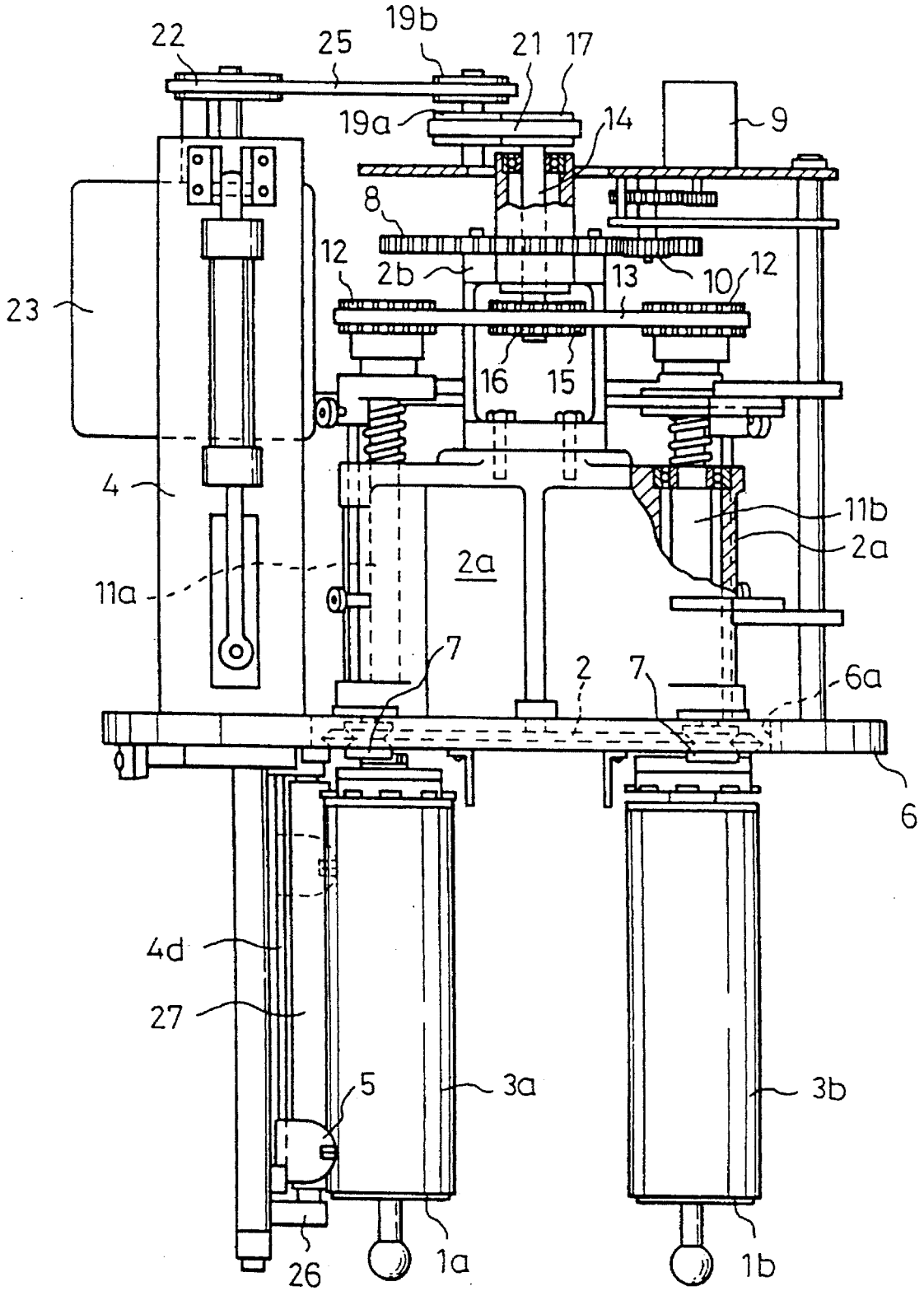
FIG. 2 is a plan view of the same.
Figure 3:
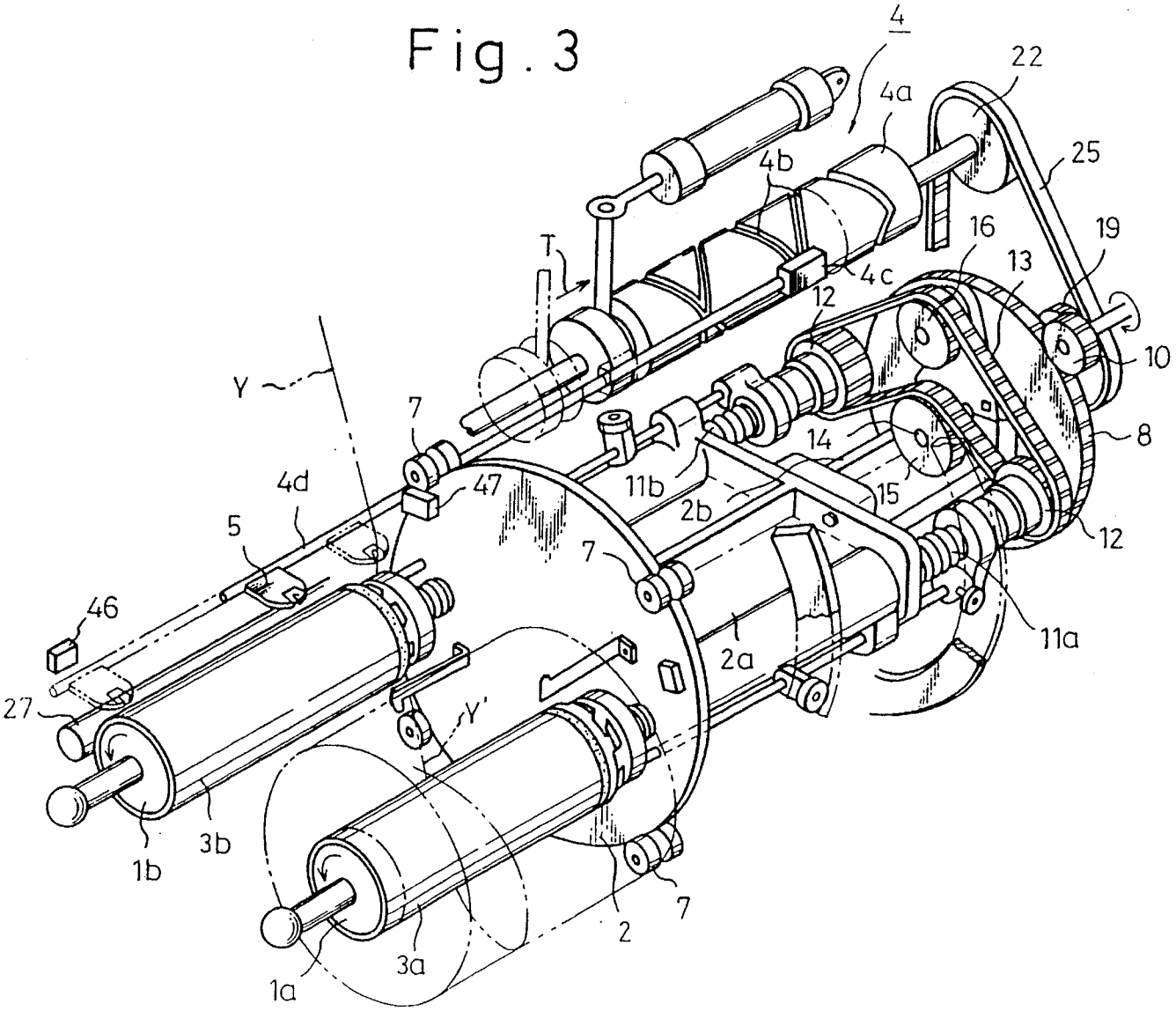
FIG. 3 is a perspective view of a main part of the same.

As illustrated in FIGS. 1 and 2, a pair of bobbin chucks la, 1*b* are rotationally arranged on a turret disc 2. One bobbin chuck 1*a* is positioned at the winding-start position A confronting a yarn traverse device 4 secured at a fixed position. A yarn Y is wound on the bobbin 3*a* held on the bobbin chuck 1*a* while traversed by a yarn traverse guide 5, as shown in FIG. 1.

The turret disc 2 is rotatably accomodated in an aperture provided in a fixed machine frame 6 while held at the periphery thereof by four rolls 7, and driven in the arrowed direction as shown in FIG. 1 by a stepping motor 9 through an intermesh between a driving gear 10 associated with the stepping motor 9 and a large wheel 8 fixedly secured on the rear part of bearing members 2*a* and a support member 2*b* of the disc 2. Spindles 11*a*, 11*b* of the respective bobbin chucks 1*a*, 1*b* support the bearing members 2*a* while passing there through and carry a pulley 12, respectively, at the free end thereof. A pulley 15 is fixedly mounted on a shaft 14 held on the support member 2b while passing through the center of the large wheel 8, and driven, together with pulleys 12, 12 secured at the ends of the respective spindle shafts, by a timing belt 13 via tension pulley 16. A pulley 17 secured at an other end of the shaft 14 and a pulley 19a of an intermediate shaft 18 are driven by a timing belt 21 via a tension pulley (not shown) which in FIG. 2, for example, may be provided along the path of travel of the belt 21. An intermediate pulley 19b and a pulley 22 secured at an end of a traverse cam 4a of the yarn traverse device 4 is driven by a driving motor 23 via a tension pulley (not shown) and a timing belt 25, the tension pulley being provided along the path of travel of the belt 25 and a timing belt 25. That is, the respective spindles 11a, 11b of the bobbin chucks 1a, 1b and the traverse cam 4a are driven by the motor 23 while maintaining a predetermined relationship between the rotational speeds thereof. In this regard, the motor 23 is either adapted to be speed-controlled automatically so that the take-up speed is kept constant in accordance with the displacement of dancer rollers due to the variation of a tension of yarn Y delivered continuously at a constant speed, or manufactured as a torque motor by which a substantially constant tension is ensured due to the principle thereof.

Accordingly, the spindles 11a, 11b, and thus the bobbin chucks 1a, 1b are simultaneously subjected to the same directional orbital motion and rotated in the same direction on their own axes by the motor 23 through an associated mechanism.

The yarn traverse device 4 is arranged behind the machine frame 6 and has a known yarn traverse cam 4a with a pair of grooves 4b across one another. By the rotation of the cam 4a, a traverse guide 5 fixed on a rod 4d connected to a sliding guide 4c engaged with the grooves 4b is subjected to a traverse motion while confronting the bobbin chuck 1a occupying the winding-start position A shown in FIG. 1 due to a reciprocated motion of the rod 4d in the lengthwise direction along the machine frame 6.

The bobbin 3a on the bobbin chuck 1a at the winding-start position A is rotated about its own axis while in contact with a pressure roller 27 and winds the yarn Y thereon. The pressure roller 27 is held at a tip end of a swingable member 26 pivotally secured on a machine frame, while being biased to the bobbin 3a on the bobbin chuck 1a by a stretching spring 100. As the winding of yarn progresses and the diameter of the bobbin increases, the pressure roller 27 is swung counterclockwise in FIG. 1 to cause the swingable member 26 to move to a position shown by a chain line, whereby the free end of the member 26 is distanced from a proximity switch 28 arranged in the vicinity thereof. This displacement is detected by the proximity switch 28 and the stepping motor 9 for the orbital motion of the turret disc 2 is started by the detected signal, whereby the turret disc 2 is subjected to the orbital motion in the counterclockwise direction. When the pressure roller 27 resumes the original position and the swingable member 26 again occupies a position shown by a solid line to be detectable by the proximity switch 28, the stepping motor 9 is made to stop but the yarn winding operation continues at that position. At stated above, the bobbin chuck 1a is intermittently subjected to a part of the orbital motion while continuing the yarn winding in accordance with the repletion of a start and stop of the stepping motor 9. When the diameter of the yarn layers on the bobbin has reached a predetermined value and the bobbin chuck 1a has occupied the full bobbin position B, a projection 29a on the turret disc 2 is in contact with a limit switch 30 on the machine frame 6. According to a detecting signal issued from the limit switch 30, the stepping motor 9 is shifted to a continuous operation phase for bobbin-switching so that the turret disc 2 is continuously subjected to the orbital motion to cause an empty bobbin 3b carried on the other bobbin chuck 1b to be displaced to the yarn-transfer position F. At this position, another projection 31b on the turret disc 2 is in contact with another limit switch 32, whereby the stepping motor 9 stops so that the full bobbin 3a and the empty bobbin 3b temporarily rest at the positions C and F, respectively, whereby the yarn-transfer operation can be correctly carried out. After the yarn-transfer operation has been completed, the stepping motor 9 is restarted and the orbital motion continues to quickly bring the empty bobbin 3b to the winding-start position A and the full bobbin 3a to the doffing-start position D, respectively. Thus the bobbin switching operation is completed. According to the repetition of the bobbin switching operations, the continuous yarn winding can be carried out without the interruption of the yarn delivery while alternately using the respective two bobbin chucks.

According to the present invention, it is important that the contact pressure applied from the pressure roller to the working bobbin (package) gradually reduces as the package develops to avoid the generation of "bulge" liable to occur in a precision winder. The bulge occurs because a winding angle of the yarn layer reduces, in the precision winding system, as a package diameter increases, resulting in the easier mobility of package structure.

Figure 5:
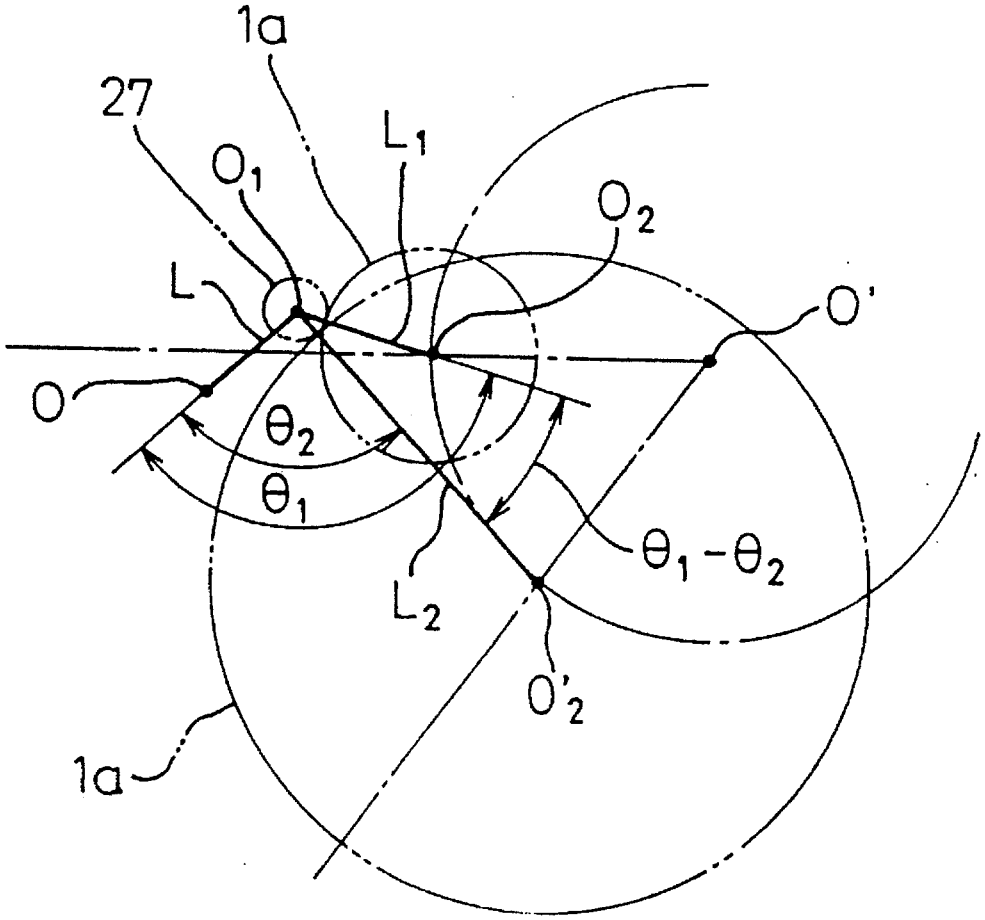
FIG. 5 is a schematic view illustrating a variation of the relationships between centers of pressure roller, bobbin chuck, turret disc and a pivotal position of swingable member.

For this purpose, as shown in FIG. 5, the pressure roller 27 is positioned substantially on a line connecting a center O' of the turret disc 2 and a center $O_2$ of the bobbin chuck 1a at the winding-start position A. In addition, a pivotal point of the swingable member 26 is positioned in a range defined by the following formula:

$$90° \leqq \theta_2 < \theta_1 < 180°$$

wherein $\theta_1$ is an angle defined between a line L extending from the center $O_1$ of the pressure roller (27) to the pivotal point O and a line $L_1$ extending from the center $O_1$ to a center $O_2$ of the bobbin chuck (1a) carrying the working bobbin (3a ) at the winding-start position A, and $\theta_2$ is an angle defined between the line L and a line $L_2$ extending from the center $O_1$ to a center $O'_2$ of the bobbin chuck (1a) carrying the working bobbin (3a ) at the full bobbin position B.

Moreover, it is necessary that a difference between the angles $\theta_1$ and $\theta_2$, that is, a directional deviation ($\theta_1-\theta_2$) of the radial component of the contact pressure directed to the center of bobbin chuck positioned at the full-bobbin position from that at the wind-start position is at least 30°.

According to this structure, a biasing force f applied on the working bobbin 3a due to the spring 100 in the direction vertical to the swingable member 27 of the pressure roller 27 is divided into a component $f_1$ directed to the center of the bobbin chuck 1a and a component $f_2$ directed to the center O of the pivotal point of the swingable member 27. The component $f_1$ that works as the center of the bobbin chuck 1a and a component $f_2$ directed to the center O of the pivotal point of the swingable member 27. The component $f_1$ that works as an effective contact pressure for the package formation is maximum at the winding-start position A, monotonously reduces as the bobbin chuck 1a stepwisely displaces in the direction of the orbital motion, and is minimum at the full-bobbin position B at which the component $f_1$ is closer to the biasing force f. In this connection, the biasing force f caused by the spring 100 is always controlled not to exceed a predetermined upper limit but to be maintained substantially at the same level by stepwisely rotating the bobbin chuck when the proximity switch 28 detects the predetermined displacement of the swingable member 26 due to the package development.

Figure 6A:
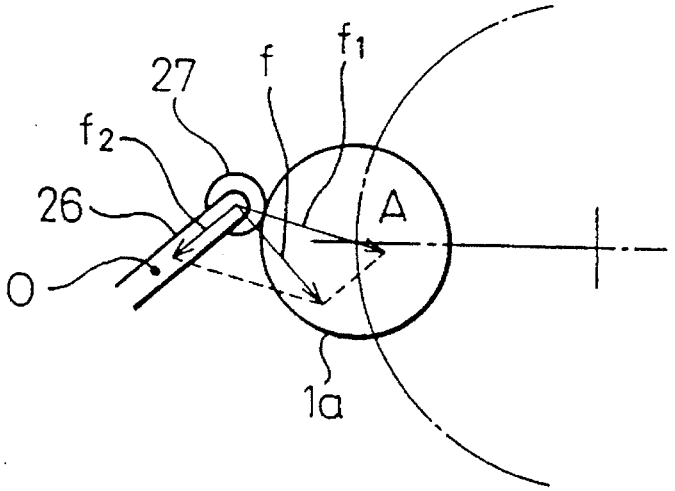
FIGS. 6(*a*), 6(*b*) and 6(*c*) are schematic views, illustrating the variation of contact pressure on the working bobbin from the pressure roller.
Figure 6B:
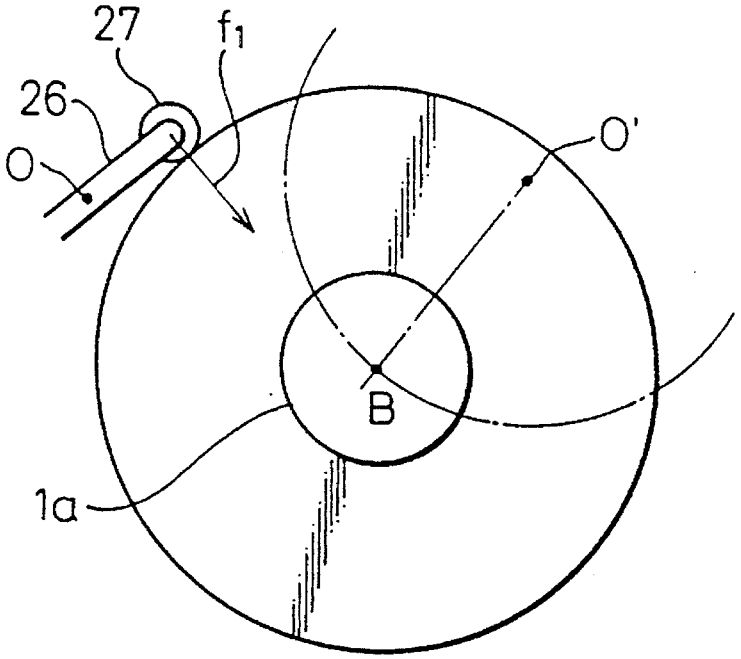
Figure 6C:
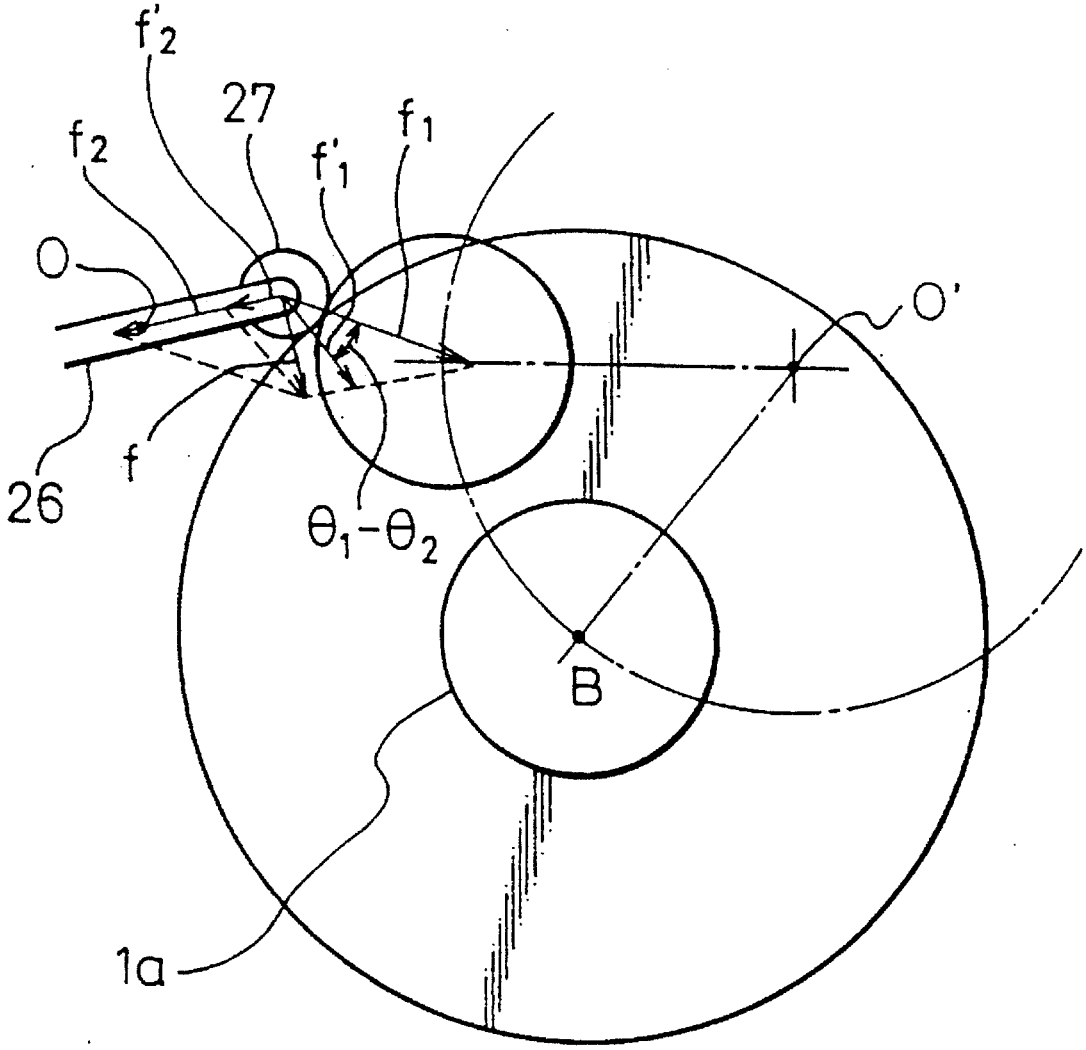

A reduction rate of the contact pressure is optionally changeable, for example, by adjusting the directional deviation ($\theta_1-\theta_2$) of the radial component $f_1$ due to the orbital motion of the bobbin chuck. As shown in FIG. 6(*c*), it is possible to define a center O of the swingable member 26 so that the component $f'_1$ at the full-bobbin position B reduces by half of that $f_1$ at the winding-start position A.

Since the radial component of the contact pressure applied on the working bobbin through the pressure roller 27 reduces in accordance with the orbital motion of the bobbin chuck, the generation of "bulge" on the package lateral sides due to the excessive internal pressure of the package can be prevented.

Control Circuit and Time Chart for Operation Sequence

Figure 4:
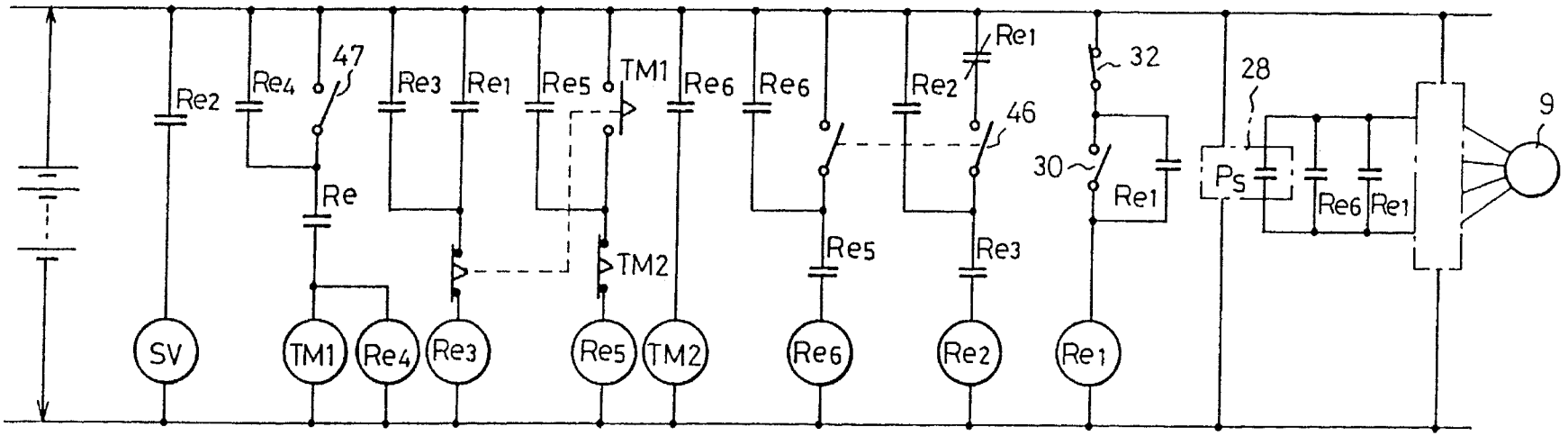
FIG. 4 is an electric circuit for the operational control of the yarn winder according to the present invention.

An operation sequence of a turret type winder according to the present invention can be controlled, for example, by an electric circuit illustrated in FIG. 4, as described below.

1. When a spindle of a bobbin chuck carrying an empty bobbin has reached a doffing-end position E after passing through a doffing section, a limit switch 30 is switched-on to energize a relay $Re_1$. Then a contact $Re_1$ is closed to continuously rotate a stepping motor 9 to cause an orbital motion. When the spindle reaches a yarn-transfer position F, a limit switch 32 is switched off to de-energize the relay $Re_1$, which causes the stepping motor 9 to stop. Even though the relay $Re_1$ is de-energized, a relay $Re_3$ is still energized by a self-hold.

2. At a yarn-transfer position F, when a limit switch 46 arranged at a turning point of the traverse motion in the tip end area of a bobbin is actuated by the traverse guide 5, a relay $Re_2$ connected in series with a contact $Re_3$ in a closed state is energized and kept in this state by a self-hold. As a result, a solenoid valve SV is energized to shift the yarn traverse cam 4*a* in the axial direction.

3. When a limit switch 47 is actuated by the traverse guide after a yarn traverse cam 4*a* has been shifted, a timer $TM_1$ connected in series with a closed contact $\overline{Re_1}$ is energized and starts a counting operation. The limit switch 47 goes from the closed state to an open state after a very short period, but, the power supply to the timer $TM_1$ is maintained by a self-hold of a relay $Re_4$ until a counting time is completed.

4. When a contact $\overline{TM_1}$ is closed after the count of the timer $TM_1$ is completed, a relay $Re_5$ is energized and simultaneously, the relay $Re_3$ is de-energized. Due to the de-energization of the relay $Re_3$, the relay $Re_2$ is also de-energized to interrupt the power supply to the solenoid valve SV so that the yarn traverse cam 4*a* is shifted to the normal position. In this connection, the timer $TM_1$ is reset by the de-energization of the relay $Re_3$.

5. When the yarn traverse cam resumes the normal position and the limit switch 46 is actuated by the traverse guide, a relay $Re_6$ connected in series with the closed contact $Re_5$ is energized and maintained in this state by a self-hold, whereby the stepping motor 9 starts a continuous rotation. A timer $TM_2$ starts a count by the energization of the relay $Re_6$ and opens a contact $\overline{TM_2}$ when that time has passed. As a result, the relay $Re_5$ is de-energized to stop the stepping motor 9.

The continuous drive of the stepping motor 9 lasts for a predetermined period set in the timer $TM_2$. Accordingly, if this period is properly selected, the spindle can travel from the yarn-transfer position F to the winding-start position A and stop at the latter position.

Figure 7:
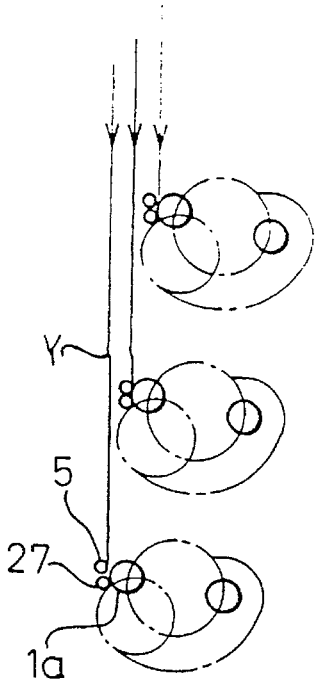
FIG. 7 is a schematic view of a multistage arrangement of winders according to the present invention.
Figure 8:
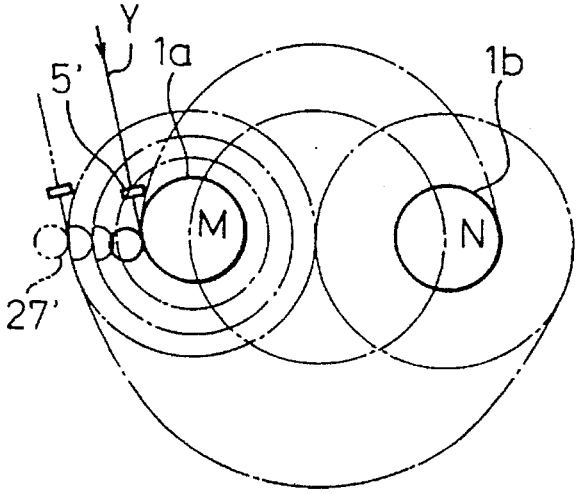
Fig.8 PRIOR ART
FIG. 8 is a front view of an operational conditions of the conventional turret type winder.
Figure 9:
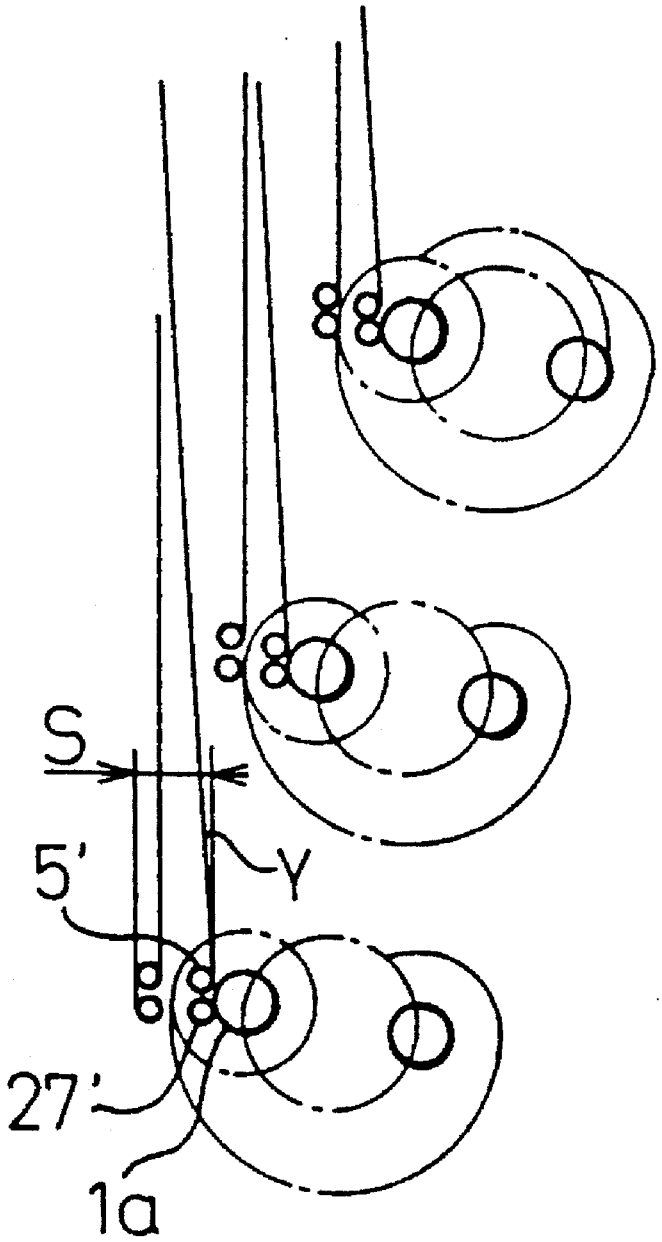
Fig.9 PRIOR ART
FIG. 9 is a schematic view of a multistage arrangement of the conventional winders, similar to FIG. 7.

According to the present invention, the pressure roller 27 and the traverse guide 5 are maintained substantially at a fixed position, when a plurality of the inventive winders are installed in a multistage manner as shown in FIG. 7, they can be arranged one above the other without a substantial gap in the horizontal direction, resulting in a space saving.

Since the radial component of the contact pressure applied by the pressure roller onto the working bobbin gradually reduces during the package formation, a well-shaped package having no bulge can be obtained without the provision of special mechanism for controlling a contact pressure.

[Industrial Applicability]

The present invention is suitably applicable to a production or take-up process for a ceramics fiber or a carbon fiber, a sizing process for a tire cord, or a rewinding process for dividing a large yarn package into a plurality of small size yarn packages.

We claim:

1. A turret type precision winder, in which a pair of bobbin chucks are arranged on a turret disc parallel to and symmetrical with each other relative to a center of the turret disc wherein one of said pair of bobbin chucks carries a bobbin comprising a working bobbin and the other of said pair of bobbin chucks carries an empty bobbin; a yarn winding operation being carried out at a constant winding ratio on the working bobbin carried by one of said bobbin chucks occupying a yarn-winding position while subjecting the yarn to a traverse motion through a traverse guide driven by a traverse cam synchronously rotating with the bobbin chuck carrying the working bobbin and applying a contact pressure by a spring onto a surface of the working bobbin through a pressure roller rotatably secured on one end of a swingable member pivoted at a fixed point by the other end thereof on the outside of the orbital motion path, and simultaneously the empty bobbin carried on the other bobbin chuck occupying a waiting position being gradually displaced to the yarn-winding position for the next yarn winding operation; the turret disc being rotated in a stepwise manner by the repetition of start/stop of a stepping motor for driving the turret disc until the working bobbin becomes full at every instant when a predetermined increment of package diameter on the working bobbin has been detected by a detector, so that the position of the pressure roller is always maintained substantially at a fixed position, characterized in that the pressure roller is positioned substantially on a line connecting a rotational center (O') of the turret disc and a center ($O_2$) of the bobbin chuck occupying the yarn-winding position, and a pivotable point (O) of the swingable member is positioned at a point satisfying the relationship defined by the following formulas:

$$90° \leqq \theta_2 < \theta_1 < 180° \quad \text{(I)}$$

$$|\theta_1-\theta_2| \geqq 30° \quad \text{(II)}$$

wherein $\theta_1$ is an angle defined between a line L extending from the center $O_1$ of the pressure roller to the pivotal point O and line $L_1$ extending from the center $O_1$ to a center $O_2$ of the bobbin chuck carrying the working bobbin at a winding-start position, and $\theta_2$ is an angle defined between the line L and line $L_2$ extending from the center $O_1$ to a center $O'_2$ bobbin chuck carrying the working bobbin at a full bobbin position.

2. A turret type precision winder as defined by claim 1, wherein the detector for detecting the displacement of the pressure roller comprises a proximity switch.

3. A turret type winder for carrying out a continuous winding operation, including a frame, a pair of bobbin chucks each having a tip end and base end, a frame-supported turret disc on which the bobbin chucks are arranged symmetrically with each other relative to a center of the turret disc, and a yarn traverse cam displaceable in the axial direction, wherein a bobbin is carried by one of the bobbin chucks for taking up yarn while subjecting the yarn to a traverse motion by a traverse guide, said traverse guide being displaceable between two turning points, each located proximate to an opposite end of said bobbin at which said traverse guide changes direction; said traverse guide being driven by a traverse cam synchronously rotating with the bobbin chuck; said traverse cam carrying a swingable member with a pressure roller rotatably secured on one end of said swingable member, the other end of said swingable member being pivotally secured on the frame at a location outside of the orbital motion path of the turret disc; wherein another bobbin carried on the other bobbin chuck occupying a waiting position is gradually displaced to the yarn winding position for the next yarn winding operation; means for rotating said turret disc in a stepwise manner for driving the turret disc until the working bobbin becomes full at every instant when a pre-determined increment of package diameter on the working bobbin has been detected by a detector, wherein the position of the pressure roller is always maintained substantially at a fixed position, wherein the pressure roller is positioned substantially on a line connecting a rotational center (O') of the turret disc and a center ($O_2$) of the bobbin chuck occupying the yarn-winding position, and a pivotable point (O) of the swingable member is positioned at a point satisfying the relationship defined by the following formulas:

$$90° \leqq \theta_2 < \theta_1 < 180° \quad \text{(I)}$$

$$|\theta_1 - \theta_2| \geqq 30° \quad \text{(II)}$$

wherein $\theta_1$ is an angle defined between a line L extending from the center $O_1$ of the pressure roller to the pivotal point O and line $L_1$ extending from the center $O_1$ to a center $O_2$ of the bobbin chuck carrying the working bobbin at a winding-start position, and $\theta_2$ is an angle defined between the line L and line $L_2$ extending from the center $O_1$ to a center $O'_2$ bobbin chuck carrying the working bobbin at a full bobbin position.

* * * * *